US006300931B1

(12) United States Patent
Someya et al.

(10) Patent No.: US 6,300,931 B1
(45) Date of Patent: Oct. 9, 2001

(54) LIQUID CRYSTAL DISPLAY

(75) Inventors: Ryuuichi Someya, Fujisawa; Nobuaki Kabuto, Kunitachi, both of (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/285,742

(22) Filed: Apr. 5, 1999

(30) Foreign Application Priority Data

Apr. 7, 1998 (JP) ..... 10-094492

(51) Int. Cl.[7] ..... G09G 3/36; G09G 5/10; G09G 5/02

(52) U.S. Cl. ..... 345/102; 345/88; 345/89; 345/147; 345/150

(58) Field of Search ..... 345/147, 150, 345/154, 88–89, 102

(56) References Cited

U.S. PATENT DOCUMENTS 5,315,695 * 5/1994 Saito et al. ..... 345/102
5,751,261 * 5/1998 Zavracky et al. ..... 345/99

* cited by examiner

*Primary Examiner*—Richard Hjerpe
*Assistant Examiner*—Duc Q Dinh
(74) *Attorney, Agent, or Firm*—Mattingly, Stanger & Malur, P.C.

(57) ABSTRACT

The apparent changes of color tones are suppressed by changing the characteristics of the voltage applied to the liquid crystal according to the switching-over of the light source intensity. Therefore, the disturbed color tones caused by a variation of the light source emission spectrum are compensated. The light source can be controlled practically, so that the liquid crystal display is sophisticated by implementing the power saving mode and extending the adjusting range of the contrast and bright levels.

9 Claims, 7 Drawing Sheets

LIQUID CRYSTAL DISPLAY

BACKGROUND OF THE INVENTION

1. Field of the Invention

The present invention relates to a display unit such as a liquid crystal display, more particularly to a liquid crystal display that can compensate changes of chromaticity caused by the switching-over of light source intensity.

2. Description of the Related Art

In recent years, liquid crystal displays have been in widespread use increasingly in various fields. For example, they are liquid crystal front projectors (front-projection type) and liquid crystal rear projectors (rear-projection type) used for presentations by projecting expanded screens of personal computers on screens, liquid crystal display monitors (direct-view type) used as monitors of personal computer screens. Those liquid crystal displays has been well-established as the popular display units next to the most popular cathode-ray tube type.

Since liquid crystal display units are not self-emission type, each of them requires a light source for displaying video images. Each of the direct-view type liquid crystal display monitors which uses a fluorescent tube as its light source switches over the output of the light source by controlling a supply power to provide many functions to cope with user's needs, such as low luminance mode and power saving mode.

On the other hand, in a case of the projection type liquid crystal front projectors and the liquid crystal rear projectors, a high-intensity light source such as a metal halide lamp is used to enable displaying of bright expanded images. However, an output switching-over which is performed for the direct-view type liquid crystal display monitor is scarcely performed in this case, because the shortening of the working life and variation of the emission spectrum may occur by the output switching-over.

Since the light source controlling will be an indispensable function for liquid crystal displays in the future, the above problems should be solved as early as possible. Of those two problems, the shortening of the working life has been improved by some operation methods. For example, the luminance and power of the object display unit is saved to avoid a full use of the display unit capacity, thereby reducing the deterioration of the light source. On the other hand, a variation of the emission spectrum has been unsolved, although it is a fatal problem to disturb the color tones of images for the display unit.

SUMMARY OF THE INVENTION

Under such circumstances, it is an object of the present invention to provide a liquid crystal display that can solve the above problems.

It is another object of the present invention to provide a liquid crystal display that can compensate changes of chromaticity caused by a variation of the light source emission spectrum at its crystal panel.

In order to achieve the above object, the present invention changes the characteristics of the voltage applied to the liquid crystal according to the switching-over of the intensity output of the light source. Therefore, the disturbed color tones caused by a variation of the light source emission spectrum are compensated and the changes of the apparent color tones are suppressed.

The present invention can thus control the light source practically so as to sophisticate the liquid crystal display, by implementing the power saving mode and extending the adjustable range for luminance.

These and other objects, features and advantages of the invention will be apparent from the following more particular description of preferred embodiments of the invention, as illustrated in the accompanying drawings.

DESCRIPTION OF THE PREFERRED EMBODIMENTS

Figure 1:
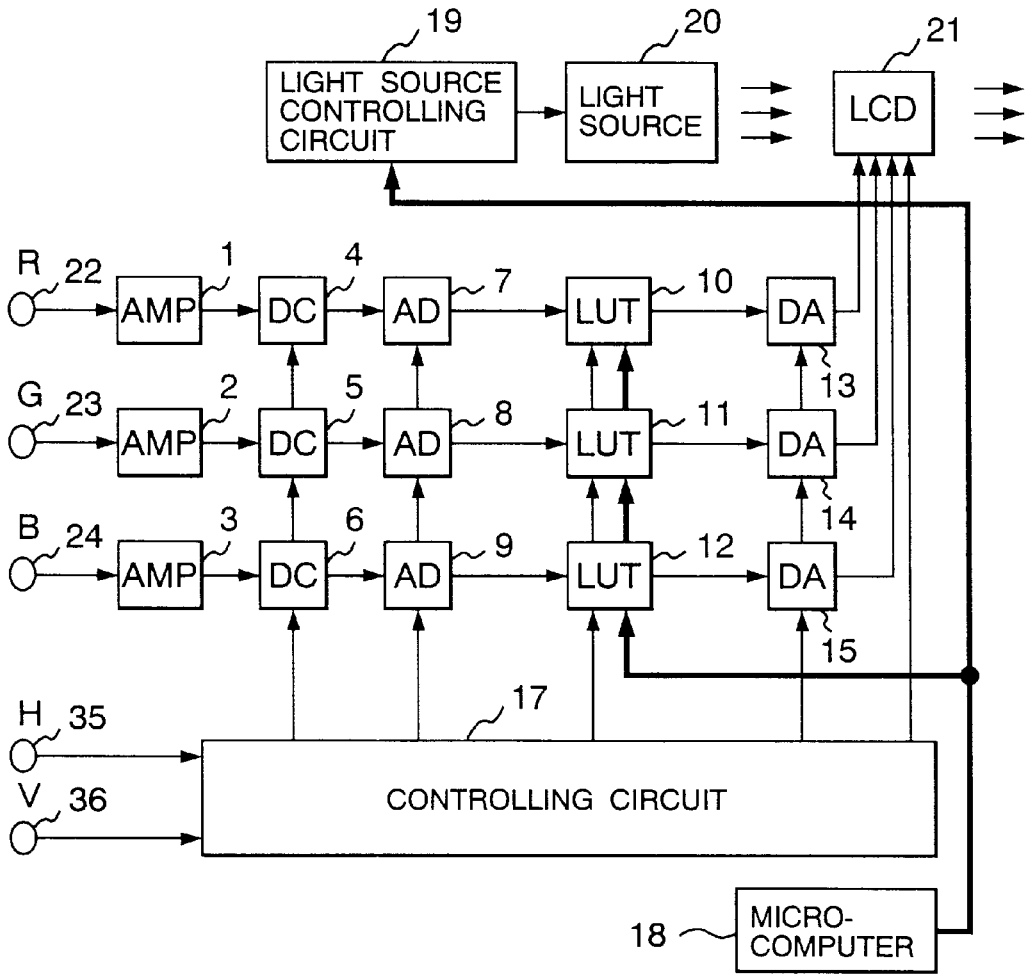
FIG. 1 is a block diagram indicating a first embodiment of a liquid crystal display of the present invention.

FIG. 1 is a block diagram indicating a first embodiment of the liquid crystal display of the present invention. Numerals 1, 2, and 3 are amplifiers (AMP), 4, 5, and 6 are clamping circuits (DC), 7, 8, and 9 are AD converters, and 10, 11, and 12 are look-up tables (LUT). Numerals 13, 14, and 15 are DA converters. A numeral 17 is a controlling circuit, 18 is a microcomputer, 19 is a light source controlling circuit, 20 is a light source, and 21 is a liquid crystal display device.

In FIG. 1, the light source controlling circuit 19 changes the intensity output of the light source 20 by varying the supply electric energy. The data in the look-up tables (LUT) 10, 11, and 12 can be rewritten using the microcomputer 18.

Hereunder, the operation of the liquid crystal display will be described with reference to FIG. 1. In FIG. 1, the RGB (red, green, and blue) video signals applied to terminals 22, 23, and 24 are entered to the amplifiers (AMP) 1, 2, and 3 and amplified to desired levels respectively. The clamping circuits (DC) 4, 5, and 6 clamp the video signals to decide the black level of those video signals. The AD converters 7, 8, and 9 convert RGB signals to digital data through sampling of those RGB signals. The look-up tables (LUT) 10, 11, and 12 store data used to convert the display characteristics of the liquid crystal display device 21 to the display characteristics of the cathode-ray tube. In other words, these look-up tables (LUT) 10, 11, and 12 convert the display characteristics with respect to the terminals 22, 23, and 24 to the display characteristics of the cathode-ray tube. Each of those look-up tables (LUT) 10, 11, and 12 can be composed of a memory such as SRAM, etc. The DA converters 13, 14, and 15 convert the digital data in the look-up tables (LUT) 10, 11, and 12 to analog signals thereby to drive the liquid crystal display device 21. Some types of the liquid crystal display device 21 can handle entered digital data as is. In such a liquid crystal display device, a digital interface circuit (not illustrated) may be used instead of each of the DA converters 13, 14, and 15. In other words, each of those DA converters 13, 14, and 15 may be replaced with an interface that can convert parallel digital data to serial digital data. In this case, the liquid crystal display device 21 is provided with serial-parallel converting circuits.

The controlling circuit 17 generates clamp pulses of the clamping circuits (DC) 4, 5, and 6, sampling pulses of the AD converters 7, 8, and 9, control pulses of the look-up tables (LUT) 10, 11, and 12, clock pulses of the DA converters 13, 14, and 15, and timing signals of the liquid crystal display device 21 according to the horizontal and vertical sync signals entered from the terminals 35 and 36.

Next, the data to be stored in the look-up tables (LUT) 10, 11, and 12 will be described with reference to FIG. 2.

Figure 2:
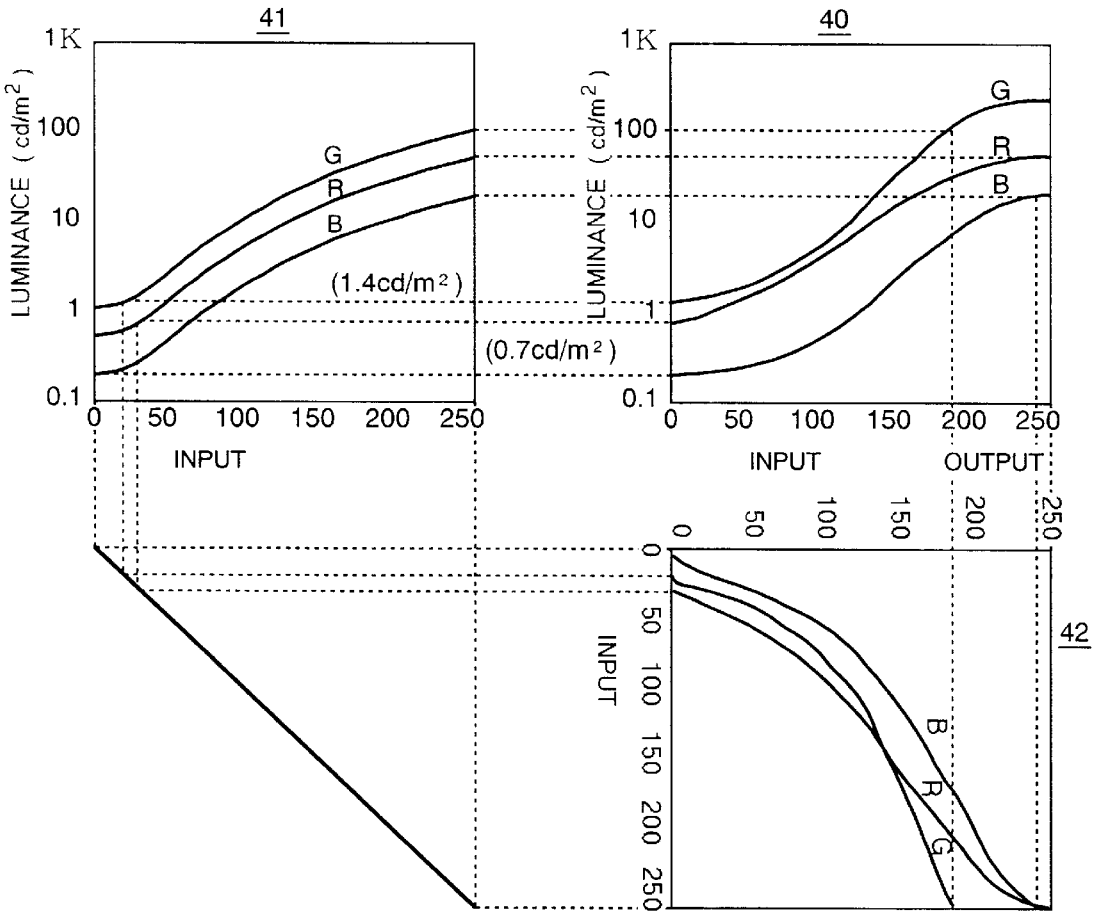
FIG. 2 is a group of graphs for creating look-up table data.

FIG. 2 shows graphs for creating look-up table data. Each of the graphs 40 and 41 uses the horizontal axis for indicating input levels with digital values and the vertical axis for indicating luminance levels (cd/m$^2$) respectively. The graph 42 indicates both input and output levels with digital values.

In FIG. 2, the graph 40 shows the input—luminance characteristics of the liquid crystal display device 21 when the light source 20 outputs the high-intensity. The RGB chromaticity points displayed on a screen at this time, that is, the RGB chromaticity points on a chromaticity diagram are assumed to be (xRh, yRh), (xGh, yGh), and (xBh, yBh).

The graph 41 shows a result of simulation of the cathode-ray tube characteristics by converting the display characteristics of the above high-intensity. The gamma value and the color temperature are assumed to become 2.6 and 9300° C. K+27MPCD (x=281, y=3.11) respectively on this graph.

In the graph 41, the RGB ratio can be found from the expressions (1) and (2) as follows.

$$\begin{bmatrix} X \\ Y \\ Z \end{bmatrix} = \begin{bmatrix} (x/y)\cdot Y \\ Y \\ (1-x-y)\cdot Y \end{bmatrix} \tag{1}$$

$$\begin{bmatrix} R \\ G \\ B \end{bmatrix} = \begin{bmatrix} xR/yR & xG/yG & xB/yB \\ 1 & 1 & 1 \\ zR/yR & zG/yG & zB/yB \end{bmatrix}^{-1} \cdot \begin{bmatrix} X \\ Y \\ Z \end{bmatrix} \tag{2}$$

At first, x=281, y=3.11, and Y=1 are assumed in the expression (1) thereby to find X, Y, and Z. The intensity Y is assumed to be unit intensity 1 to find the RGB ratio. Then, X, Y, and Z, as well as the RGB chromaticity points (xRh, yRh), (zGh, yGh), and (xBh, yBh) are substituted for the expression (2) to find the RGB ratio.

In this graph 41, the minimum value of the color B matches with the minimum value of the color B in the graph 40. The graph 41 also shows the target input—luminance characteristics when the liquid crystal display device 21 is seen through the look-up tables (LUT) 10, 11, and 12. The data in those look-up tables (LUT) 10, 11, and 12 is thus used to convert the characteristics of the graph 40 to the characteristics of the graph 41. The data of the look-up tables (LUT) 10, 11, and 12 is obtained as follows.

The graphs 40 and 41 are disposed side by side as shown in FIG. 2, then the input level of the graph 40 is corresponded to the output level of the graph 42, and the input level of the graph 41 indicating the same level intensity as that of each color with respect to the input level of the graph 40 is corresponded to the input level of the graph 42 for plotting both graphs, thereby the characteristics as shown on the graph 42 are obtained. These characteristics are assumed as data in the look-up tables (LUT) 10, 11, and 12. The luminance characteristics of the cathode-ray tube shown on the graph 41 can be obtained if the output level of the graph 42 is supplied to the liquid crystal display device 21 with respect to the input level of the graph 42.

As shown on the graphs 40 and 41 clearly, the colors R and G are saturated to the output 0 at an input level of about 30 or 20. This is because the liquid crystal display device 21 having the display characteristics as shown on the graph 40 cannot output colors R and G at the minimum luminance of about 0.7 cd/m$^2$ and at about 1.4 cd.m2 or under respectively. Consequently, the white color temperature (930° C. K+27MPCD in this embodiment) specified above can be reproduced accurately in the range not less than 30 of an input level.

When data in the look-up tables (LUT) 10, 11, and 12 is set as described above, video images can be displayed while the light source 20 is in the high-intensity state.

Next, description will be made for the operation of the liquid crystal display of the present invention when the intensity output of the light source 20 is switched to the low intensity with reference to FIG. 3.

Figure 3:
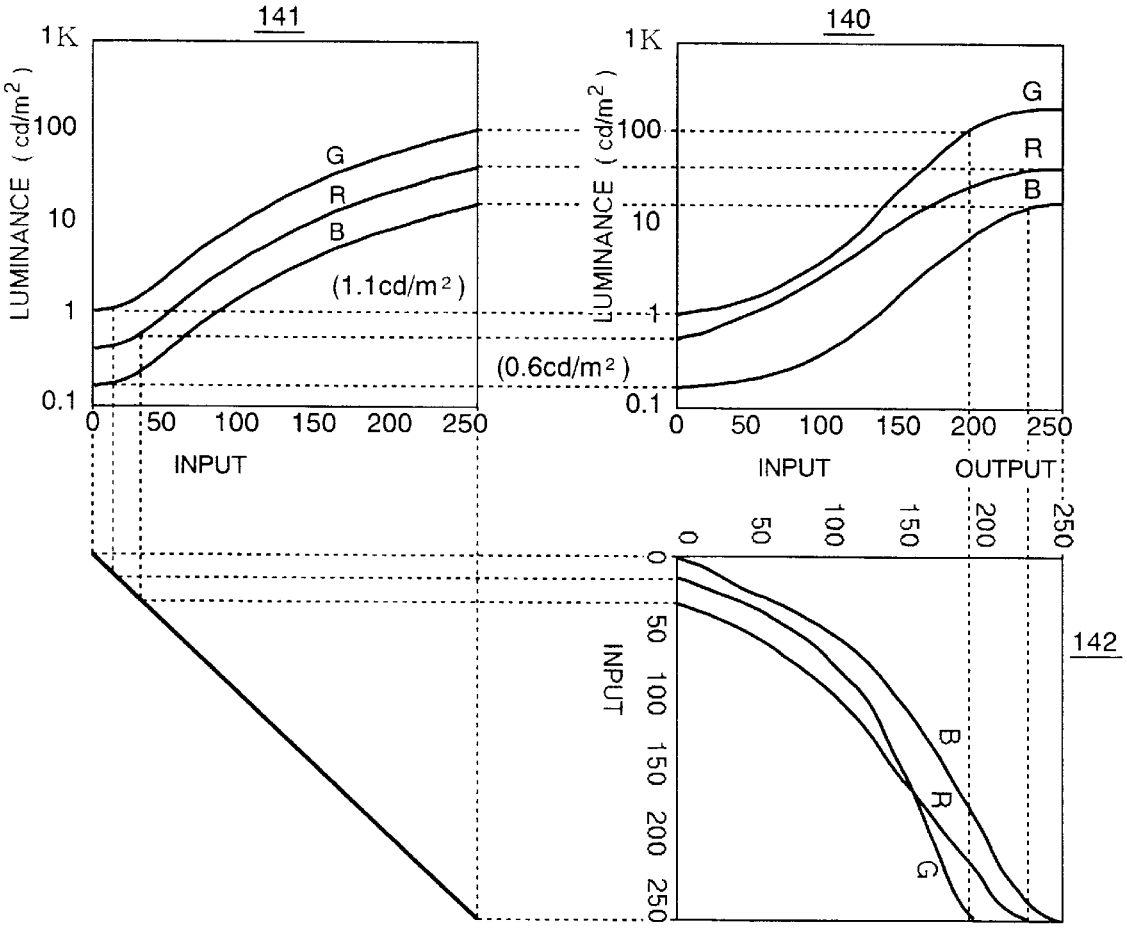
FIG. 3 is a group of graphs for creating look-up table data.

FIG. 3 shows graphs for creating data in the look-up tables (LUT). On the graphs 140 and 141, the horizontal axis indicates input levels with digital values and the vertical axis indicates luminance levels (cd/m$^2$). The graph 142 is created from the graphs 140 and 141. On the graph 142, the horizontal axis indicates input levels with digital values and the vertical axis indicates output levels with digital values.

The graph 140 in FIG. 3 indicates the input—luminance characteristics of the liquid crystal display device 21 while the light source 20 is in the low intensity state. In this case, the RGB chromaticity points on the screen are assumed to be (xR1, yR1, (xG1, yG1), and (xB1, yB1).

Just like in the high intensity state, the RGB ratio is found using the expressions (1) and (2). If it is assumed now that the gamma value is 2.6 and the white color temperature is 9300° C. K+27MPCD (x=281, y=3.11), thenthegraph141 is obtained. Just like in the high intensity state, the graph 142 of the low intensity state is obtained from the graphs 140 and 141. This graph 142 provides data in the look-up tables (LUT) 10, 11, and 12 when the light source 20 is in the low intensity state. Since how to create the graph 142 is the same as that shown in FIG. 2, the description will be omitted here.

As a result, the changes of the color tone to occur when the light source 20 is switched to the low intensity state, that is, the changes of the color tones to occur when the RGB chromaticity points are changed from (xRh, yRh), (xGh, yGh), and (xBh, yBh) in the high intensity state to (xR1, yR1), (xG1, yG1), and (xB1, yB1) in the low intensity state can be compensated with rewriting of the data in the look-up tables (LUT) 10, 11, and 12. Color changes can thus be prevented.

According to the present invention, therefore, it is possible to compensate disturbed color tones to be caused by a variation of the light source emission spectrum at the liquid crystal panel by changing the characteristics of the voltage applied to the liquid crystal according to the switching-over of the light source intensity, thereby changes of the apparent color tones can be suppressed as described above.

Figure 4:
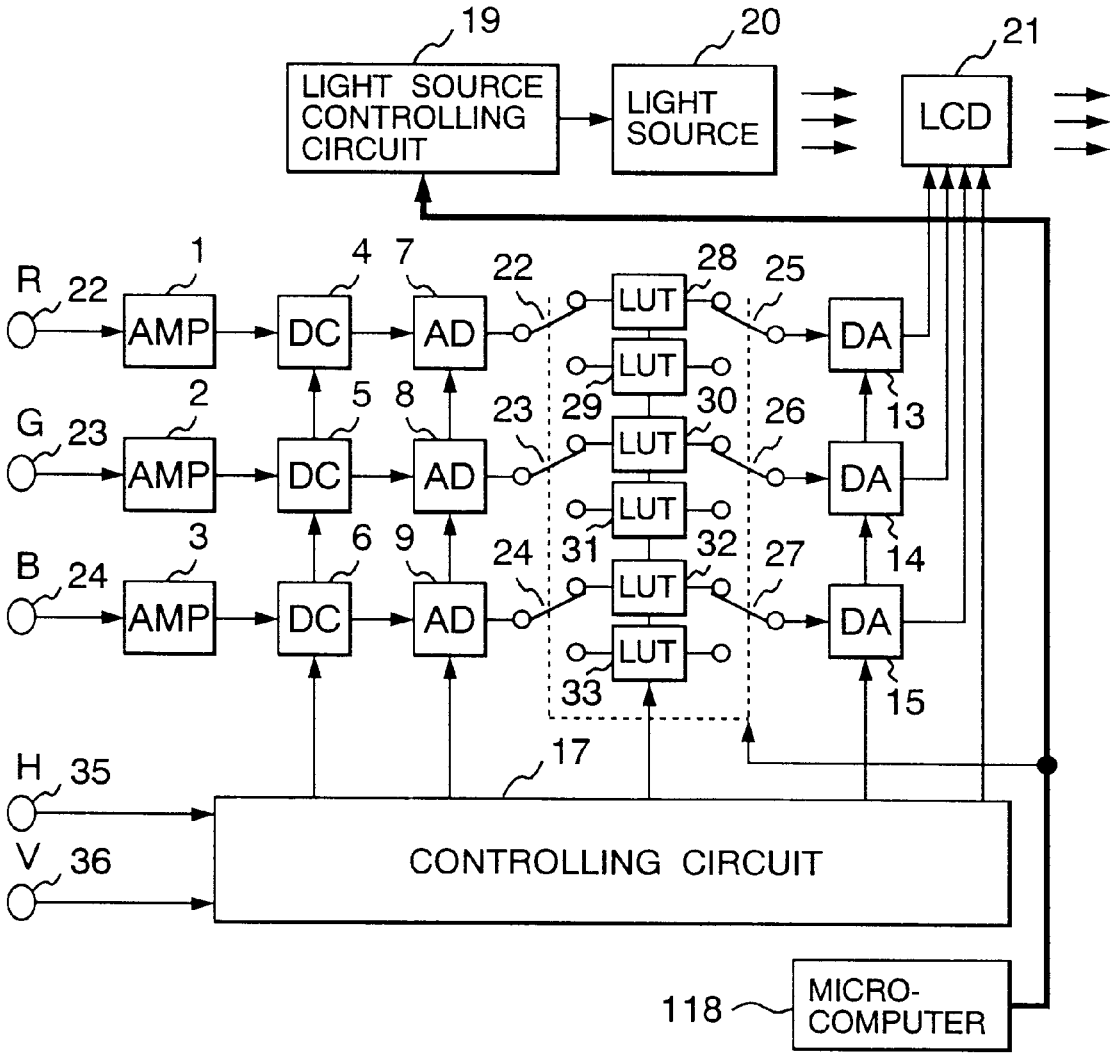
FIG. 4 is a block diagram indicating a second embodiment of the liquid crystal display of the present invention.

FIG. 4 shows a block diagram indicating a second embodiment of the liquid crystal display of the present invention. In FIG. 4, 22 to 27 are switching means, 28 to 33 are look-up tables (LUT), and 118 is a microcomputer. Other items are the same as those shown in FIG. 1, so the same reference numerals are given to them.

In the first embodiment, the data of the graphs 42 shown in FIG. 2 and the data of the graph 142 shown in FIG. 3 are written in the look-up tables (LUT) 10, 11, and l2 using the microcomputer 18. In this second embodiment, however, two types of look-up tables (LUT) are used. Concretely, look-up tables (LUT) of one type are provided for the data in the high intensity state and the look-up tables (LUT) of the other type are provided for the data in the low intensity state. And, one of the two types of look-up tables (LUT) is selected according to the Osl switching-over of the light source intensity. In the look-up tables (LUT) 28, 30, and 32 is written the data of the graph 42 shown in FIG. 2, which is the data in the high intensity state and in the look-up tables (LUT) 29, 31, and 33 is written the data of the graph 142 shown in FIG. 3, which is the data in the low intensity state. When the intensity of the light source 20 is switched by the microcomputer 118 via the light source controlling circuit 19, the switching means 22 to 27 are also switched over respectively. When the light source 20 is in the high intensity state, the look-up tables (LUT) 28, 30, and 32 are selected and when the light source 20 is in the low intensity state, the look-up tables (LUT) 29, 31, and 33 are selected by the switching means 22 to 27 respectively.

Consequently, just like in the first embodiment, it is possible to compensate the changes of color tones caused by the changes of the RGB chromaticity points along with the switching-over of the intensity of the light source 20 by switching over the look-up tables (LUT) 28, 30, and 32. Changes of the colors can thus be avoided. Since it is possible to switch over the look-up tables (LUT) with the switching means 22 to 27 instantly in this embodiment, there is no need to rewrite the data in the look-up tables (LUT), which is indispensable in the first embodiment. The performance of the microcomputer 118 can thus be reduced by many eliminated functions, and a low-priced microcomputer can be used.

As described above, the present invention can compensate the disturbed color tones caused by a variation of the light source emission spectrum at the liquid crystal panel by changing the characteristics of the voltage applied to the liquid crystal according to the switching-over of the light source intensity, thereby suppressing the changes of the apparent color tones.

Figure 5:
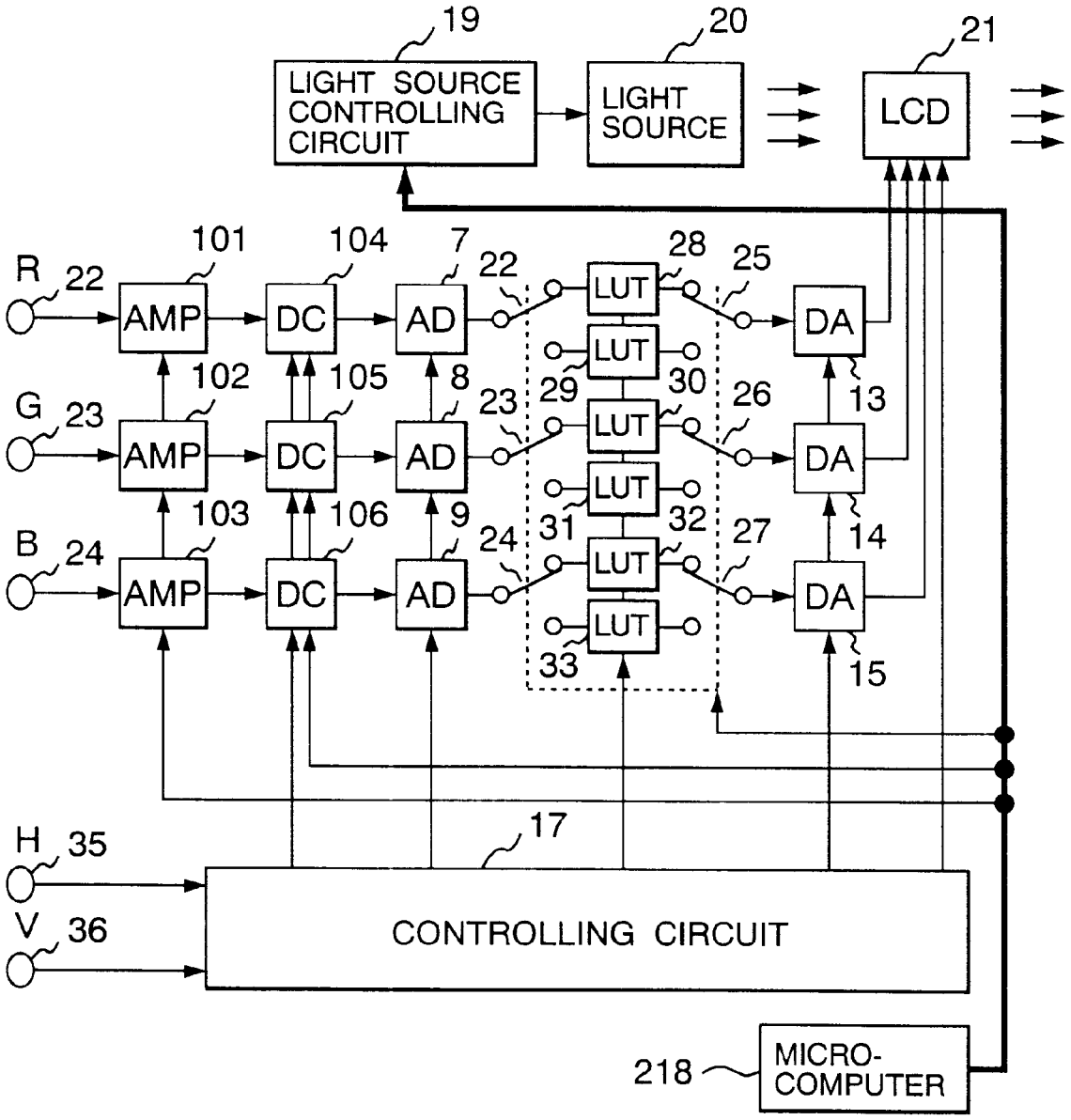
FIG. 5 is a block diagram indicating a third embodiment of the liquid crystal display of the present invention.

FIG. 5 shows a block diagram indicating a third embodiment of the liquid crystal display of the present invention. 101, 102, and 103 are amplifiers (AMP) having variable gains. 104, 105, and 106 are clamping circuits (DC) having variable clamping levels. Other items are the same as those shown in FIG. 4, so the same reference numerals are given to them.

In this embodiment, the microcomputer 218 can be ganged with the switching-over of the look-up tables (LUT) 28, 30, and 32, as well as the look-up tables (LUT) 29, 31, and 33 thereby to control the gains in the amplifiers 101, 102, and 103, as well as the clamping levels in the clamping circuits 104, 105, and 106. Consequently, it is possible to avoid the changes of the contrast and brightness levels to occur according to the switching-over of the light source intensity, thereby to eliminate the apparent feeling that something is wrong with the colors.

Figure 6:
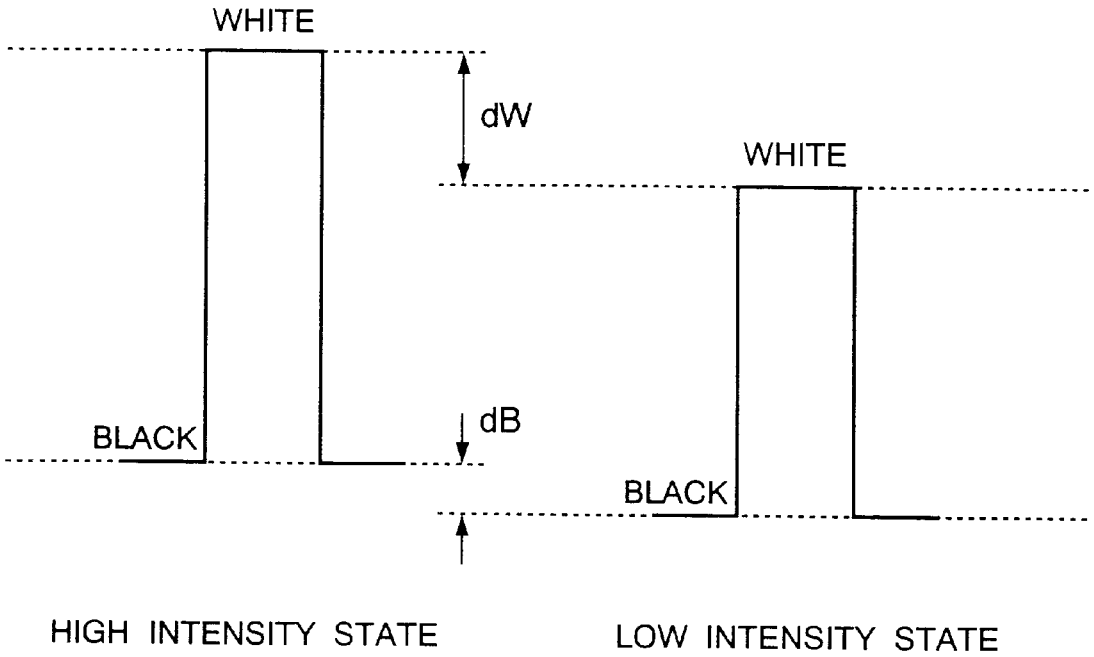
FIG. 6 is an explanatory view of both white and black levels of a luminance signal in both high and low intensity states.

FIG. 6 shows an explanatory view of the white and black levels of the luminance signal in the high and low intensity states. In FIG. 6, dB indicates a difference of the black level between high and low intensity states and dW indicates a difference of the white level between high and low intensity states.

At first, the intensity of the light source 20 is switched from high to low and the look-up tables (LUT) 28, 30, and 32 are switched over to the look-up tables (LUT) 29, 31, and 33, thereby to compensate the shifting of the color tones. At this time, a black level difference dB and a white level difference dW from those in the high intensity state are generated.

In the microcomputer 218 is written such data. Consequently, the clamping levels in the clamping circuits (DC) 104, 105, and 106 are increased by dB, as well as the gains in the amplifiers (AMP) 101, 102, and 103 are increased by dW, thereby the contrast and the bright levels are returned to those of the high intensity state.

Consequently, the contrast and bright levels can be kept constantly regardless of the switching-over of the light source intensity. Furthermore, since the intensity of the light source can be switched over in this embodiment, the adjusting ranges of the contrast and bright levels become wider than those in the embodiment in which only the voltage applied to the liquid crystal is changed.

Furthermore, the intensity of the light source, the look-up tables (LUT), the amplifiers (AMP), and the clamping circuits (DC) are ganged for controlling as described above, Ithe user can set the video state to his/her taste only by increasing/decreasing the contrast and bright levels regardless of the switching-over of the light source intensity.

According to the present invention, it is thus possible to enhance the functions of the liquid crystal display such as extension of the adjusting range of the contrast/bright level as described above.

Figure 7:
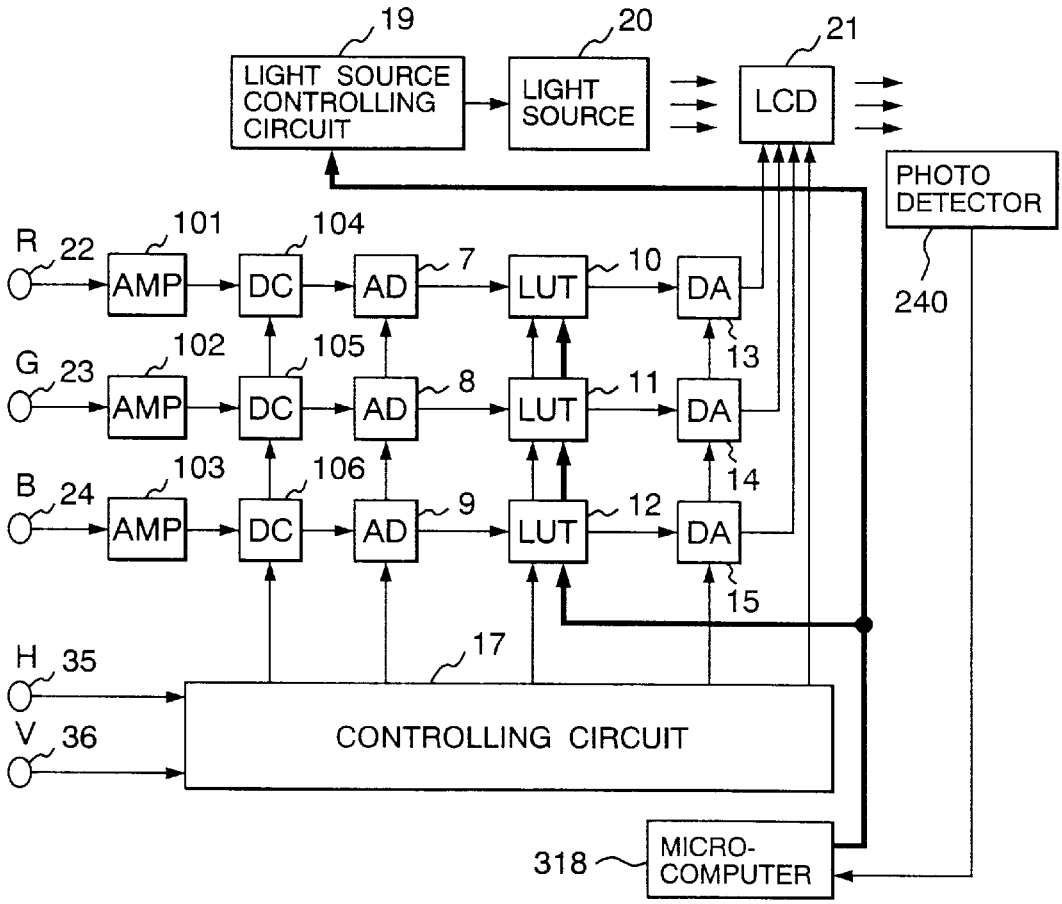
FIG. 7 is a block diagram indicating a fourth embodiment of the liquid crystal display of the present invention.

FIG. 7 shows a block diagram indicating a fourth embodiment of the liquid crystal display of the present invention. In FIG. 7, 240 is light detecting means. Other items in FIG. 7 are the same as those shown in FIG. 1, so the same reference numerals will be used for them.

This embodiment is characterized by that a photo detector 240 is used to detect the luminance level and chromaticity point of each of the RGB signals. The driving characteristics of the liquid crystal display device 21 are changed according to, for example, the switching-over of the intensity of the light source 20. Hereunder, examples of the driving characteristics will be described.

In the first example, the microcomputer 318 is used to find and rewrite the data in the look-up tables (LUT) 10, 11, and 12 as described with reference to FIGS. 2 and 3 according to the luminance level and chromaticity point of each of the RGB signals detected in the photo detector 240.

In the second example, the luminance level and ichromaticity point of each of the RGB signals detected in the photo detector 240 are compared with those in the initial state of adjustment written in the microcomputer 318, thereby finding compensated data, which is then used to rewrite the data in the look-up tables (LUT) 10, 11, and 12.

In the third embodiment, the luminance levels and chromaticity points of the RGB signals detected in the photo detector 240 are compared with those in the initial state of adjustment written in the microcomputer 318, and the look-up tables (LUT) 101, 102, and 103 or the clamping circuits (DC) 104, 105, and 106 are adjusted to compensate the difference in the comparison, thereby changing the amplitude or the DC level of each of the video signals. In this third example, the amplifiers (AMP) 101 to 103 and the clamping circuits (DC) 104 to 106 may be adjusted at the same time.

Consequently, it is possible to suppress even the changes of the luminance and color tone caused by the deterioration of the light source with time, thereby to improve the liquid crystal display more significantly.

As described above, according to the present invention, it is possible to compensate disturbed color tones caused by a variation of the light source emission spectrum at the liquid crystal panel by changing the characteristics of the voltage applied to the liquid crystal according to the switching-over of the light source intensity, thereby to suppress the changes of the apparent color tones.

It is thus possible to control the light source practically, thereby improving the functions and reliability of the liquid crystal display such as execution of the power saving mode, as well as extension of the adjusting range of the contrast and bright levels.

The present invention may be embodied in other specific forms without departing from the spirit or essential characteristics thereof. The present embodiment is therefore to be considered in all respects as illustrative and not restrictive, the scope of the invention being indicated by the append claims rather than by the foregoing description and all changes which come within the meaning and range of equivalency of the claims are therefore intended to be embraced therein.

What is claimed is:

1. A liquid crystal display, comprising a plurality of liquid crystal display devices corresponding to a plurality of input color signals;

a light source used for said liquid crystal display device;

a light source controlling circuit for controlling the intensity of said light source;

a converter having a plurality of input-output luminance characteristics each of which correspond to said plurality of input color signals, and a setting part for setting one of said plurality of input-output luminance characteristics as input-output luminance characteristics of said converter according to the intensity of said light source which is changed by said light source controlling circuit;

wherein said plurality of input color signals are converted for each color signal by said converter according to said input-output luminance characteristics set by said setting part, and said converted color signals are supplied to said plurality of liquid crystal display devices, such that color tones disturbed depending on the variation of light emission intensity from said light source are compensated when said light source controlling circuit changes the intensity of said light source.

2. A liquid crystal display according to claim 1, wherein said converter includes a look-up table and said setting part includes a microcomputer, and said setting part writes one of a plurality of said input-output luminance characteristics written in said microcomputer in said look-up table depending on the change of the intensity of said light source.

3. A liquid crystal display according to claim 1, wherein said converter includes first and second look-up tables, said setting part includes a microcomputer, said first look-up table stores first input-output luminance characteristics and said second look-up table stores second input-output luminance characteristics, and one of said first and said second look-up tables is selected by said microcomputer according to said light emission intensity of said light source for setting as said input-output luminance characteristics of said converter.

4. A liquid crystal display, comprising:

a plurality of liquid crystal display devices corresponding to a plurality of input color signals;

a light source used for said plurality of liquid crystal display devices;

a light source controlling circuit for controlling the intensity of said light source;

a photo-detector for detecting a light output from said plurality of liquid crystal display devices;

a converter having a plurality of input-output luminance characteristics, each of which corresponds to one of said plurality of input color signals, and a setting part for setting one of said plurality of input-output luminance characteristics as input-output luminance characteristics of said converter according to a result detected by said photo-detector;

wherein said plurality of input color signals are converted by said converter for each color signal according to said input-output luminance characteristic set by said setting part, and said converted color signals are supplied to said plurality of liquid crystal display devices, such that color tones disturbed depending on the variation of light emission intensity from said light source are compensated.

5. A liquid crystal display according to claim 3, wherein said liquid crystal display further includes a variable gain amplifier for amplifying video signals to control the gain level of said variable gain amplifier depending on a switching-over operation of said converter.

6. A liquid crystal display according to claim 3, wherein said liquid crystal display further includes a variable clamping circuit for controlling the DC level of video signals to control the clamping level of said clamping circuit depending on a switching-over operation of said converter.

7. A liquid crystal display according to claim 4, wherein said converter includes first and second look-up tables, said setting part includes a microcomputer, said first look-up table stores first input-output luminance characteristics and said second look-up table stores second input-output luminance characteristics, and one of said first and said second look-up tables is selected by said microcomputer according to said light emission intensity of said light source for setting as said input-output luminance characteristics of said converter.

8. A liquid crystal display according to claim 7, wherein said liquid crystal display further includes a variable gain amplifier for amplifying video signals to control the gain level of said variable gain amplifier depending on a switching-over operation of said converter.

9. A liquid crystal display according to claim 7, wherein said liquid cyrstal display further includes a variable clamping circuit for controlling the DC level of video signals to control the clamping level of said clamping circuit depending on a switching-over operation of said converter.

* * * * *